US007261212B2

(12) United States Patent
Sholem

(10) Patent No.: US 7,261,212 B2
(45) Date of Patent: Aug. 28, 2007

(54) TOOL ORGANIZER SYSTEM AND METHODS

(76) Inventor: Steven Sholem, 6121 N. 1st Ave., Phoenix, AZ (US) 85013

( * ) Notice: Subject to any disclaimer, the term of this patent is extended or adjusted under 35 U.S.C. 154(b) by 0 days.

(21) Appl. No.: 11/423,636

(22) Filed: Jun. 12, 2006

(65) Prior Publication Data

US 2006/0226098 A1 Oct. 12, 2006

Related U.S. Application Data

(62) Division of application No. 10/465,412, filed on Jun. 18, 2003, now Pat. No. 7,073,672.

(51) Int. Cl.
*A47F 7/00* (2006.01)

(52) U.S. Cl. ..... 211/70.6; 211/87.1; 211/DIG. 1

(58) Field of Classification Search ..... 40/913; 211/70.6, DIG. 1, 60.1, 87.01; 248/206.5, 248/309.4, 205.2; 335/285; 206/350
See application file for complete search history.

(56) References Cited

U.S. PATENT DOCUMENTS

| | | | |
|---|---|---|---|
| 361,248 A | 4/1887 | Winton | |
| 1,531,070 A | 3/1925 | Bruns | |
| 2,414,653 A | 1/1947 | Lookholder | |
| 2,642,999 A | 6/1953 | McPherson | |
| 2,697,804 A | 12/1954 | Phelon | |
| 2,733,113 A | 1/1956 | Humbargar | |
| 2,966,992 A | 1/1961 | Dunkelberger et al. | |
| 3,195,021 A | 7/1965 | Martin | |
| 3,387,341 A | 6/1968 | Mates et al. | |
| 3,419,832 A | 12/1968 | Baermann | |
| 3,769,720 A * | 11/1973 | Terrones | 434/127 |
| 3,827,021 A | 7/1974 | Phelon | |
| 4,056,190 A | 11/1977 | Dix | |
| 4,183,439 A | 1/1980 | Bell | |
| 4,405,108 A | 9/1983 | Muirhead | |

(Continued)

FOREIGN PATENT DOCUMENTS

| | | |
|---|---|---|
| GB | 2084374 | 4/1982 |

*Primary Examiner*—Blair M. Johnson
(74) *Attorney, Agent, or Firm*—Schmeiser, Olsen & Watts LLP

(57) ABSTRACT

In one aspect, tool organizer system has a flat sheet of magnetically attracted material that attracts magnets attached to tools to support the tools on the flat sheet. The system includes position indicators that can be attached at any orientation and position on the flat sheet. Neither the position indicators nor the tools are limited to particular positions or orientations such as by a repeating or incremental support structure on the flat sheet. Thus, the position indicators and tools can be grouped in closely abutting relation when desired for space saving organization. The system can be provided as a kit with one or more components. In another aspect, a method of organizing a set of tools provides for efficient use of space on an open flat sheet, provides for clear association between a tool and a previously selected position on the flat sheet, and avoids loss of tools by placing them in previously selected positions. In still another aspect, a method of making a tool organizer system includes making the system in accordance with requests from a customer. The requests can include a set of position indicators based on a particular set of tools to be stored and organized with the system. Furthermore, the method of making can be facilitated by providing options and receiving requests over the Internet.

16 Claims, 3 Drawing Sheets

U.S. PATENT DOCUMENTS

| | | | | |
|---|---|---|---|---|
| 4,451,810 | A | 5/1984 | Miller | |
| 4,586,616 | A | 5/1986 | Cooper et al. | |
| 4,682,691 | A | 7/1987 | Spiering | |
| 4,826,059 | A | 5/1989 | Bosch et al. | |
| 5,064,159 | A | 11/1991 | Kotick | |
| 5,217,294 | A | 6/1993 | Liston | |
| 5,301,822 | A | 4/1994 | Coleman et al. | |
| 5,639,138 | A | 6/1997 | Smith | |
| 5,671,849 | A | 9/1997 | Bacon | |
| 5,725,096 | A | 3/1998 | Winnard | |
| 5,738,423 | A | 4/1998 | Alfaro | |
| 5,760,668 | A | 6/1998 | Testa et al. | |
| 5,785,187 | A | 7/1998 | Lipman et al. | |
| 5,913,500 | A | 6/1999 | Estes | |
| 5,957,421 | A * | 9/1999 | Barbour | 248/220.21 |
| 6,360,464 | B1 | 3/2002 | Tate | |
| 6,575,313 | B1 | 6/2003 | Chen | |
| 6,587,022 | B1 | 7/2003 | Devine | |
| 6,626,303 | B1 | 9/2003 | Moodie | |
| D485,297 | S | 1/2004 | Reda et al. | |
| 7,073,672 | B2 * | 7/2006 | Sholem | 211/70.6 |
| 2001/0028208 | A1 | 10/2001 | Reilly | |
| 2002/0055878 | A1 * | 5/2002 | Burton et al. | 705/26 |
| 2006/0000788 | A1 * | 1/2006 | Sholem | 211/70.6 |

* cited by examiner

TOOL ORGANIZER SYSTEM AND METHODS

CROSS REFERENCE TO RELATED APPLICATION

This application is a divisional of the earlier U.S. Utility patent application to Steve Sholem entitled "TOOL ORGANIZER SYSTEM AND METHODS," Ser. No. 10/465,412, filed Jun. 18, 2003 now U.S. Pat. No. 7,073,672 the disclosure of which is hereby incorporated entirely herein by reference.

BACKGROUND OF THE INVENTION

1. Technical Field

This invention generally relates to a tool storage and organization devices, and specifically to a storage and organization device that enables a user to selectively group and position tools on a mounting board.

2. State of the Art

Tool storage devices of the past include tool boxes and peg boards. Tool boxes have trays and drawers for organizing tools. Some tool boxes are large and form cabinets. Some tool cabinets also include peg boards. However, tool boxes and tool cabinets have lids or doors enclosing the tools. Furthermore, the drawers and compartments are typically stacked in a compact arrangement.

Peg boards, whether in combination with tool boxes or not, typically have a repeating pattern of holes or other mounting structure. The repeating pattern of holes or other structure provides incremental positions at which objects can be supported. Pegs are typically inserted in the holes or the other mounting structure provides protrusions for engaging tools. Thus, the tools are typically supported at positions that can be incrementally adjusted to discrete positions corresponding to the repeating pattern of holes or other mounting structure.

DISCLOSURE OF THE INVENTION

The present invention relates to a tool storage and organization device that enables a user to selectively group and position tools on a mounting board. The peg boards and other storage devices of the past are deficient, on the other hand, because they limit the orientations of stored tools and the position of the tools on a support substrate. This is because the peg board holes and other mounting structures on the support substrates of past devices generally have an incremental or repeating pattern. For example, when a peg board has pre-drilled holes disposed at one inch increments, the tools supported on the peg board are located at discrete positions corresponding to the holes. This is because pegs are limited to being supported in pre-drilled holes. If a user wants to move the mounting pegs closer together or wants to group the tools by tool type, he or she is generally limited to the positions provided by the locations of the pre-drilled holes or the other incremental mounting structure.

Even in past devices in which a continuous strip of magnetic, hook, or loop material is attached to the support substrate, the tools are limited to mounting in positions that have been predetermined by the placement of the strip of material.

The past devices are also deficient in providing a very durable hard finish to a peg board. Normally, peg boards are formed of a pressed board material and the holes for the pegs are drilled through the press board. A relatively non-durable paint may be applied to one surface of the peg board. Therefore, the peg boards of the past are vulnerable to marring during storing and retrieving of tools.

The tool boxes and cabinets of the past enclose tools that are stored therein. Even if the doors and drawers are left open, the compact nature of tool boxes and cabinets generally causes at least some of the tools in the boxes or cabinets to be layered and hidden from view. That is, the tool boxes and cabinets of the past are deficient because they generally require a user to open and close drawers and to dig for tools during their search for a particular tool.

On the other hand, in a simple form, the present invention overcomes these deficiencies and inadequacies with a tool organizer system that has a flat sheet of magnetically attracted material that is not part of another support structure. The system includes at least one tool that has a magnet. At least one position indicator is selectively placed on a front face of the flat sheet. The position indicator has a shape and/or a size adapted to match the at least one tool. The flat sheet forms a single substrate with a height, a width, and a thickness. The flat sheet has a property throughout the height, the width, and the thickness that together with the magnet holds the weight of the at least one tool on the front face of the sheet. Advantageously, the tool organizer system is structurally very simple with no element of the system that extends outside the height, the width, and the thickness and that has a property or a geometry for holding the weight of the at least one tool on the front face of the sheet.

The tool organizer system is generally for a plurality of tools and includes a plurality of position indicators. The tools can be formed from predecessor tools that have been modified by adding respective magnets. Alternatively or additionally, the tools can have embedded magnets that are integral with the tools. Importantly, the front face of the flat sheet is smooth and free of incremental holes or protrusions for mounting tools on the front face of the flat sheet. Thus, the position indicators and tools can be mounted without limitation to their positions and orientation.

In one aspect, the tool organizer system includes hook and loop fasteners connecting at least some of the tools to the flat sheet to additionally mount the tools on the flat sheet. Additionally or alternatively, the tool organizer system can have at least one additional tool with hook and loop fasteners connected to the at least one additional tool and to the flat sheet to mount the at least one additional tool on the flat sheet. Using hook and loop fasteners has the advantage of enabling mounting positions that are not limited to a particular position or orientation. However, the mounting position is established by the extra step of mounting one of hooks and loops on the support substrate, whereas using magnets and a magnetically attracted flat sheet provides unlimited positioning and orientation without the step of mounting a separate attachment mechanism to the support substrate. Furthermore, when using hook and loop fasteners, it is not easy to change the position of the attachment mechanism on the support substrate. Conversely, magnets and the magnetically attracted sheet permit changing the mounting position because the attachment mechanism is inherently provided throughout the sheet by nature of the material of the sheet. Furthermore, magnets and the magnetically attracted flat sheet have the added advantage of enabling twisting reorientation of the tools without the need to lift the tools from the flat sheet. In another aspect, the flat sheet is to be coated with a resistant finish for improved aesthetics and durability. This finish can be provided as a baked powder coating on a front face of the flat sheet.

The tool organizer system includes an additional attachment mechanism that selectively mounts the flat sheet on a wall. This additional mounting mechanism can include any of a variety of conventional mounting devices. By way of example and not by way of limitation, the additional mounting mechanism can include through holes and screws, bolts, hooks, wire, brackets, adhesive, and/or magnets. In particular, the screws can be wood, plaster, brick, or concrete screws. Furthermore, the screws can be expansion screws for mounting the flat sheet on a plasterboard or cinder block wall.

In another aspect, the present invention includes a tool set organizer system kit. The kit of the invention can include one or more of several components for packaging and distribution in accordance with customer requests. The components of such a kit can include a continuous flat sheet of magnetically attracted material that has a front face. Similar to the system described above, the front face does not have an incremental pattern of tool mounting structure. The kit may also include a set of position indicator decals adapted for placement on the flat sheet. The position indicator decals are also not incrementally limited. The kit may also include a set of tool magnets adapted to magnetically attach tools to the flat sheet. In at least some cases, the kit will include a set of tools. The set of magnets can be operatively connected to the tools or supplied separately for attachment to the tools by a user of the kit. The sets of tools, position indicator decals, and magnets can each be a set of greater than one.

In another aspect of the invention, the set of position indicators can include pictures of the tools in the set of tools to be stored. Such a set can be provided in a kit of the invention. Furthermore, the kit can include hook and loop fasteners adapted to additionally or alternatively mount the tools of the set of tools to the flat sheet. The kit can also include fasteners adapted to mount the flat sheet on a wall. Additionally, the kit can further include one or more pictures adapted for placement at any position on the front face of the flat sheet.

In still another aspect, the present invention includes a method of storing and organizing tools. The method can include mounting on a wall, an unenclosed flat sheet comprising a front face having magnetically attracted material. The method also includes selecting a tool mounting position in an area including substantially all of the front face of the flat sheet. In this step, the tool mounting position will not be limited to incremental positions. A position indicator is placed at the tool mounting position. Of course, when there are a plurality of tools to be stored, a plurality of tool mounting positions not limited to incremental positions are selected and position indicators are placed at these positions. The method of storing and organizing can alternatively or additionally include adhering a magnet or one of a hook and loop fastener to the flat sheet for connection with a complimentary portion of a fastening mechanism that resides on a tool, for example.

In one aspect, the method of storing and organizing includes the step of matching the tools with respective position indicating decals that uniquely corresponds to the tools. In another aspect, the method includes storing the tools by magnetically attracting the tools to the flat sheet at any position on the front face. The tools need not be limited to the tool mounting positions or any incremental positions. In still another aspect of the method of storing and organizing, storing the tools includes magnetically attracting at least some of the tools to the flat sheet while additionally or alternatively attaching at least some tools to the flat sheet by hook and loop fasteners.

In still another aspect, the present invention includes a method of making a tool organizer. This method can include receiving a request for at least one of a base color and/or texture, a picture to be displayed on the tool organizer, and a set of position indicators based on tools to be organized. The method of making the tool organizer can include forming the organizer of an unsupported, unenclosed, flat sheet of magnetically attracted material. The method of making can also include forming the organizer to have no incremental holes or protruding structure for supporting tools on a front face of the flat sheet. The method of making also includes providing at least one of the base color or texture, the picture, and the set of position indicators in accordance with the customer request. In one aspect, the step of receiving a request includes receiving a customer request over the Internet.

In another aspect, the method of making the tool organizer can include receiving a request for a set of tools including a particular brand. The step of providing in this case includes providing the set of tools and the set of position indicators including at least one of a particular shape, size, or color, corresponding to the particular brand. On the other hand, if the requester already has a set of tools, he or she will simply want to match the tools that he or she has. Therefore, receiving a request includes receiving a request for matching the system with a set of tools, which may include a particular brand.

In still another aspect, the method of making the tool organizer includes providing the set of position indicators as full-size color pictures of tools of the set of tools. The method of making the tool organizer can also include receiving a request for one or more of a plurality of predetermined pictures displayed on a web site configured for Internet orders. Alternatively or additionally, the method of making can include a request for a picture, a copy of which is included in digital form together with the request over the Internet.

When the method of making a tool organizer includes a request for a base color and/or texture, the step of providing can be accomplished by electrostatically coating the flat sheet with a powder comprising a requested color and/or texture. Then the flat sheet and coating is baked at temperatures in a range from 375 degrees F. to 400 degrees F. to form a very hard, durable, yet aesthetic flat sheet.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
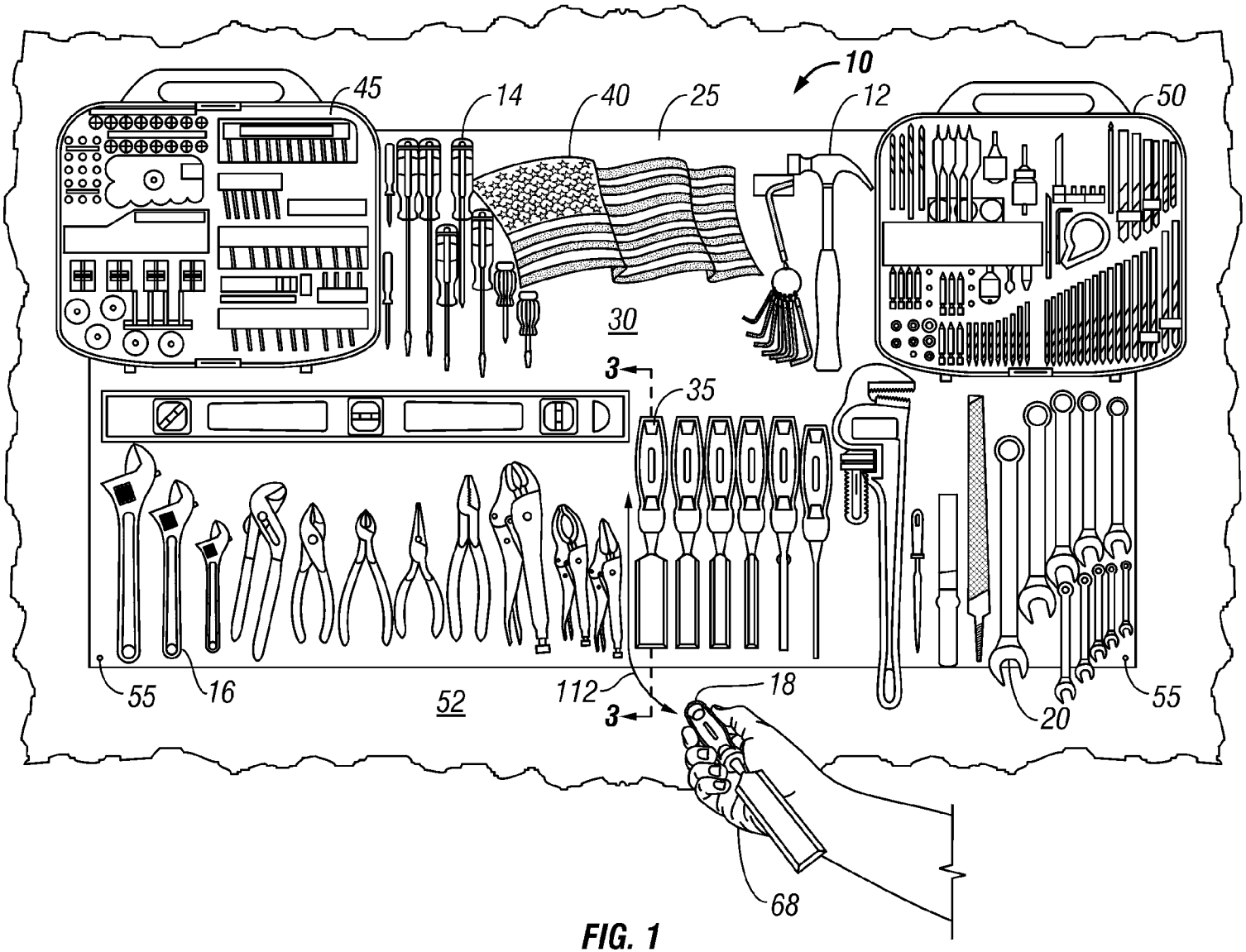
FIG. 1 is a perspective view of a tool organizer system and method of storing and organizing according the present invention.

As discussed above, embodiments of the present invention relate to a tool organizer system 10 for storing and organizing a set of tools of which tools 12, 14, 16, 18, 20 are examples. As shown in FIG. 1, the system 10 includes a flat sheet 25 of magnetically attracted material. This material typically is made of a sheet of metal, such as ferrous metal. However, the thin sheet 25 could also comprise a composite with metal material dispersed in the sheet or a lamination with a thin magnetically attracted sheet in a front position among the laminants. The flat sheet of material includes a front face 30 for supporting the tools 12, 14, 16, 18, 20. A position indicator as shown at 35 is provided for each of the tools to be supported on the front face 30. These position indicators 35 can take any of many forms. By way of example and not by way of limitation, the position indicators 35 can include adhesive backed decals. Other ways of providing the position indicators 35 include painting such as by stencils, or by attaching silhouette or cutouts substrates in the form of the respective tool.

In a broad sense, the position indicators 35 could take the form of color coded marks or shapes that correspond to colors applied to the tools. Furthermore, position indicators in the form of markers having shapes associated with particular tools could be used as position indicators. Further alternatively, shapes that are not associated with a particular tool or its function, but which are distinct from one another could be applied to the tool and a position at which a respective tool would be mounted on the face 30. In a particularly attractive embodiment, the position indicators 35 comprise a full sized color picture of each tool to be mounted on the face 30. In this way, confusion can be avoided and a comparison will bear out which tool is to be mounted in a particular location. With digital photo technologies, position indicator decals comprising full sized color pictures can be made and printed on sticky back decals substrates. Alternatively, similar images can be placed on plastic or vinyl sheets that can be easily pealed off and put back on a surface without a distinct adhesive layer or backing. This would have the advantages of removal and replacement without leaving a sticky or resinous residue, and decals formed in this way would be capable of repeated removal and replacement without loss of adhesive capability. Such decals include but may not be limited to those that adhere by static cling to most smooth surfaces.

Similar to the position indicator decals 35 additional pictures 40 can be provided in a similar manner. Such pictures could include advertisements, trademark(s) or pictures for decoration purposes. Pictures 40 can include flags, logos, or emblems for a sports team or other organization that provides a sense of identity for a particular user. The picture 40 can be provided as a decal or can be painted during manufacturing. The picture 40 may be an advertisement and include an illustration of a particular product such as an automobile part, for example.

Advantageously, the position indicator decals 35 and the picture 40 can be located at any position on the entire surface of front face 30 of the flat sheet 25. In this way, tools can also be positioned at any location on the front face 30 of the flat sheet 25 without covering the picture 40. Alternatively, the tools can be positioned in overlying relation to the picture 40. As shown in FIG. 1, the tools may be grouped together with other like tools for convenience and organization. Since the entire metallic sheet 25 comprises magnetically attracted material, positioning of the tools is not limited to specific incremental positions on the front face 30. Likewise, the position indicators 35 can be located at any position on the front face 30. As shown in FIG. 1, some of the tools are positioned in closely abutting relation to each other. The capability of the organizing system to enable positioning of the tools in closely abutting relation and in any orientation has great space saving advantages. This feature also allows subsets such as bit and grinder sets 45, 50 to be attached at convenient locations on the front face 30. These advantages are not achieved by peg boards which, for example, would require mounting of the tools and the bit sets at specific locations limited by the incremental attachment structure of such peg boards. Furthermore, the flat sheet 25 of the system can be conveniently mounted to a wall 52 by way of fasteners 55 as shown in FIG. 1.

Figure 2:
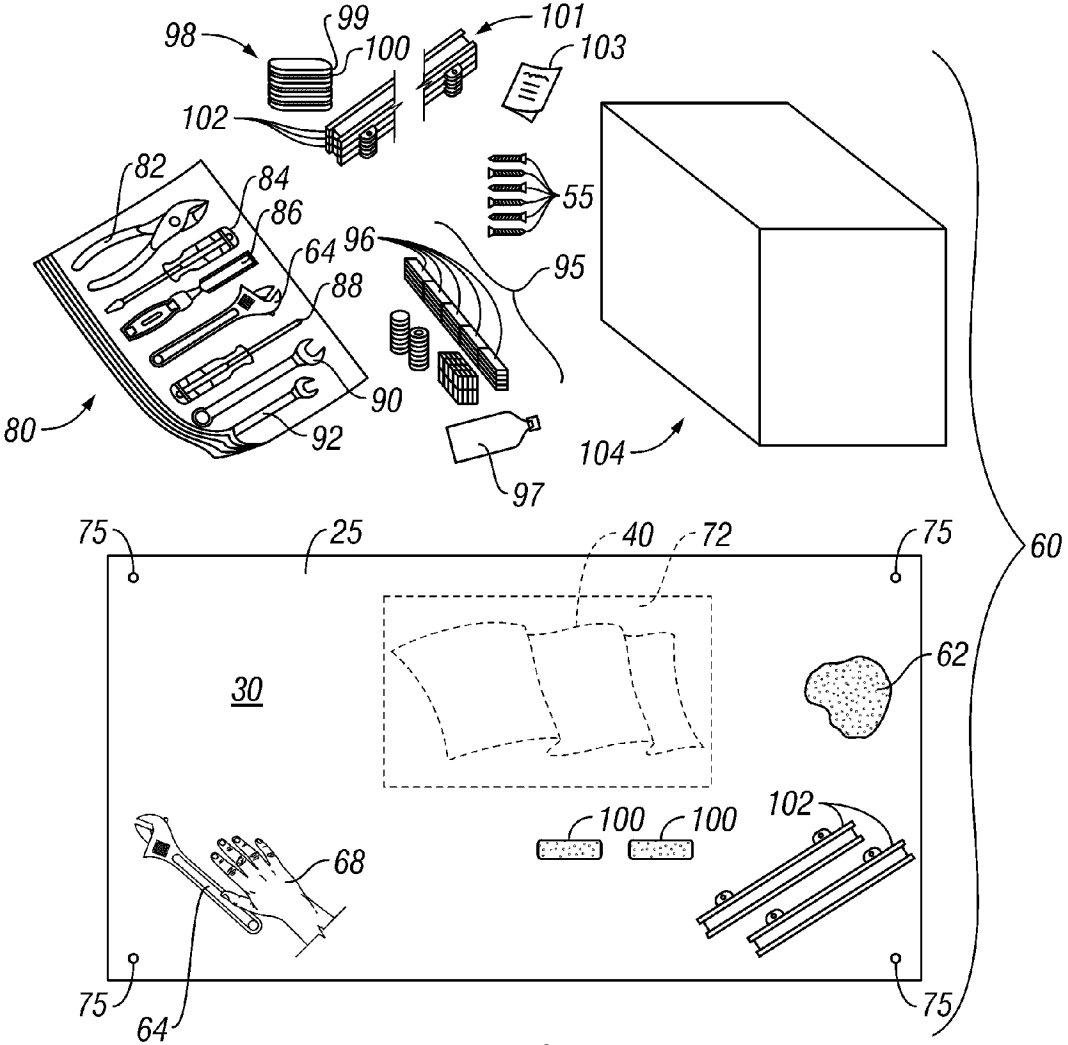
FIG. 2 is a perspective view of a tool set organizer kit and a method of storing and organizing according to the present invention.

FIG. 2 shows a kit 60 of a tool set organizer system in accordance with the present invention. The kit includes the flat sheet 25 that can be coated with a durable hard material providing at least a front face 30 with an aesthetic appearance. The coating can be made smooth as shown in FIG. 1 or can be textured as shown at 62 in FIG. 2. A roughened or textured coating can provide the advantage of a frictional engagement by tools being held on the flat sheet. The kit also includes position indicators such as decal 64 to be placed on the flat sheet 25. The position indicators can be placed on the flat sheet 25 by a user's or a manufacturer's hand 68. Alternatively or additionally, position indicators could be painted on or otherwise provided during manufacturing. In this case, the kit may be provided without position indicators. The picture 40 can be included with the kit 60. In one embodiment the picture 40 is provided as a sticky backed decal. To this end, a sticky backed substrate 72 can be provided with the picture 40 cut out in a predetermined shape including the picture 40. Alternatively, the decals can be provided in as plastic or vinyl that adheres to the front face 30 by nature of the materials of the decal and the front face 30. As best illustrated in FIG. 2, through holes 75 are provided in corners of the flat sheet 25. Additional through holes may be provided for additional securing capability.

The kit 60 also includes a plurality of sheets 80 of position indicators in the form of decals. The position indicators include the decal 64 and additional exemplary decals 82, 84, 86, 88, 90 and 92. These decals can be selectively peeled off of the sheets 80 and selectively position on the front face 30 of the flat sheet 25 by hand as indicated at 68. It is to be understood that the sticky backed decals 64, 82, 84, 86, 88, 90, and 92 could be replaced by paper or any other substrate cut to the particular shape of the tool or simply having a silhouette or picture of the tool to be stored. With a non-sticking back, the kit may include a glue for adhering the position indicators on the flat sheet 25. Alternatively, the decals can be formed of a sheet of plastic, vinyl, or acrylic material that readily adheres to the front face 30 of the flat sheet 25 without the use of a separate adhesive or sticky backing. This can be accomplished, for example, by static cling that the particular material of the sheet tends to have. Further, alternatively, the substrates comprising the position indicators could be magnetic or have magnets attached to enable easy removal and replacement of the position indicators at any position as needed over time.

The kit may also include a set of separate magnets 95 for attachment to tools to be used with the system 10. Magnets of the set can have a variety of shapes and sizes as shown at 95. By way of example and not by way of limitation, magnets 96 of the set 95 are elongate block magnets, while others are shorter block, circular, and toroid shaped magnets. Furthermore, the magnets can be strong rare earth magnets such as Neodymium or Samarium, which, by their appearance, may have the advantage of adding beauty to the tools to which they are attached. In particular, the appearance of a Neodymium magnet can be affected by a nickel coating that is applied to protect the magnet from corrosion and cracking. The Samarium magnets may have a rough outer surface that could advantageously aid in frictionally holding the magnet and tool from sliding on the flat surface 25. Alternatively, the magnets can be ceramic or alnico. The variety and number of magnets provided should enable holding tools from four ounces to five pounds on the flat sheet. Of course, more than one magnet can be attached to a tool. However, the magnets should be of the lowest profile possible in order to avoid interference with proper function of the tool and/or discomfort to the user. The magnets can include a sticky back on one surface for attachment to the tools. Alternatively, a tube of adhesive 97 can be included with the kit for attachment of the magnets 95 to the tools.

Alternatively or additionally, the kit 60 can include a set of hook and loop fasteners 98 each comprising a hook substrate 99 and a loop substrate 100. Similarly, the kit 60 can include a set of magnetic strips 101 comprising individual strips 102. The hook and loop fasteners 99, 100 and the magnetic strips 102 can be placed at any position and orientation on the front face 30 of the flat sheet 25. Thus, hook and loop fasteners 99, 100 and magnetic strips 102 provide a similar advantage of enabling unlimited tool positioning and orientation as set forth with regard to attachment directly to the flat sheet by a magnet on the tool. However, addition of the hook and loop fastener 99, 100 or magnetic strip 102 provides a system kit 60 that is slightly less simple than a kit without the hook and loop fasteners 99, 100 or magnetic strips 102. Yet, some tools may be particularly well adapted for attachment to the flat sheet 25 by these alternative or additional mechanisms. For example, the drill bit and grinder subsets 45, 50 may benefit from attachment to the flat sheet 25 by hook and loop fasteners 99, 100 over a larger surface area of the front face 30 than is typically provided by magnets. Another advantage is that the hook and loop fasteners 99, 100 could be provided in a variety of colors, shapes, sizes, and holding strengths that may surpass those available with a set of magnets for a particular holding application. Furthermore, the magnetic strips 102 may be particularly advantageous, for example, when a magnetically attracted portion of the tool is available for attachment to the magnetic strips 102. However, the hook and loop fasteners 99, 100 and/or the magnetic strips 102 are generally intended to be incorporated in addition to the holding mechanism of magnets attached to tools and magnetically attracted directly to the flat sheet 25. Furthermore, large or heavy tools such as bit and grinder subsets 45, 50 can be magnetically supported by adding more magnets from the set of magnets 95.

The kit 60 can include a set of instructions 103. The set of instructions can include a detailed step-by-step description and/or figures to help a person prepare his or her kit for use. The set of instructions will include instructions for guiding a user during attachment of the magnets to a set of tools, for example, based on the particular adhesive being used. The adhesive 97, for example, could be a five minute epoxy that requires specific steps in preparation and application. Of course, the kit can include a plurality of fasteners 55 for engaging in holes 75 in order to attach the flat sheet 25 to a wall.

The kit 60 can also include and be sold together with a set of tools 104. This set of tools 104 can be a set of mixed and matched tools that are ordered at the time purchase of the kit 60. Alternatively, the set of tools can be a matched set. These tools may be standard off the shelf tools that are available in stores or directly from manufacturers. Alternatively or additionally, the tools in set 104 can include special tools that have been made with magnets already attached or embedded.

Figure 3:
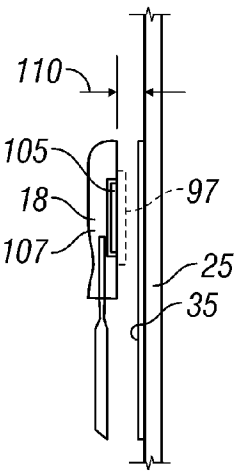
FIG. 3 is a sectional view taken along lines 3-3 of FIG. 1, but with a tool positioned over the flat sheet according to an embodiment of the present invention.

FIG. 3 shows a sectional view of the tool 18 and the flat sheet 25. As shown, the tool 18 has a magnet 105 embedded in the handle 107. Alternatively, a magnet 96 from the set of magnets 95 can be attached to an exterior of the tool handle 107, for example. In either case, the tool 18 will be pulled into contact with the flat sheet 25 under the influence of the magnetic attraction between the magnet 105 or the magnet 97 and the sheet 25. This magnetic attraction will be sufficient to pull the tool into holding contact when the tool is released within a certain predetermined range 110. This range 110 is typically from zero to one half of an inch. However, with stronger magnets this range may be increased.

In one aspect, the present invention includes a method of using a system for storing and organizing tools. As shown in FIGS. 1 and 2, this method includes selecting positions for placement of a variety of tools on a flat sheet of magnetically attracted material. Once the positions have been selected the position indicators are attached to those positions as shown at 68 in FIG. 2. Advantageously, the positions for attachment of the tools are not limited to incremental positions. This is due to the fact that there are no incremental holes or other attaching structure for mounting the tools on the front face 30 of the flat sheet 25, as is typical with peg boards and the like. Once the positions have been selected and the position indicators have been placed on the front face 30, the tools may be stored in an organized fashion. FIG. 1 shows tools in superimposed relation overlapping the position indicators with which they are associated. As depicted in FIG. 1, a tool 18 can be grasped by a user's hand 68 and removed from or placed on the front face 30 as indicated by double headed arrow 112. It is intended that a tool will be stored in overlying relation with the position indicator with which it is associated. Advantageously, the system does not require the user to place the tool precisely on the position indicator. That is, if the user misses the mark, the tool will still be held to the front face 30 of the flat sheet 25 because the magnetic attraction is present at all locations on the front face 30. However, the intention is that by storing the tools in the preselected positions, the set of tools can be well organized in order to facilitate finding a particular tool when it is needed.

As an alternative to the position indicators in the form of decals shaped and sized similarly to the tools to be stored, the position indicators can be provided as outlines or cutouts in the shape of the tools to be stored. In one case for example, a sheet of material could be provided for a set of tools. This sheet of material can include outlines or cutouts of each of the tools in the set. Thus, by applying a single decal or sheet, positions and orientations for a complete set of tools can be established. Similarly, such a sheet can include cutouts for more than one set of tools on the sheet. Sheets bearing outlines or cutouts of a variety of sets of tools can be provided to include position indicators for all of the tools to be stored and organized. In use, the present invention has the advantage of spreading the tools out in front of the user in a manner that facilitates easy access and enables the user to quickly see all of the tools, and the locations for missing tools, at once. Unlike storing the tools in a toolbox or in a cabinet, the present invention allows the user to quickly grasp a tool without having to open a drawer or dig through several other tools. To this end, it is intended that the flat sheet will be a flat sheet that is not supported in a cabinet or enclosed in any way. However, it is to be understood that the flat sheet can be of any of a variety of sizes and shapes and could be one of a plurality of flat sheets that are usable together. Each of a plurality of sheets could be mounted on one or more walls without departing from the spirit and scope of the invention. Alternatively, the flat sheets could be mounted on a pivotal axis in order to provide access to the various sheets by swinging one sheet about the axis in order to access a second sheet and so forth. In this arrangement, the sheets could advantageously be left open and unenclosed. Further alternatively, it is to be understood that separate sheets could be slidingly mounted on a wall or other support without departing from the spirit and scope of the invention. For example, a plurality of flat sheets can be placed in non-overlapping relation to enable unenclosed access to tools on the flat sheets.

Figure 4:
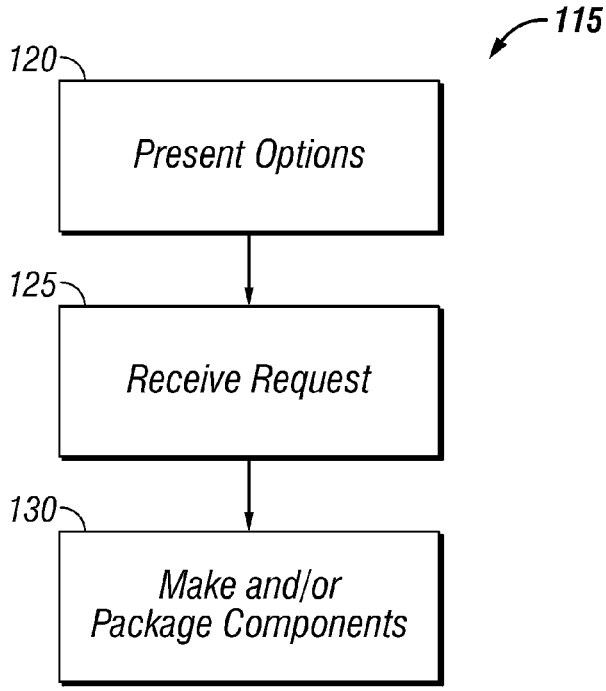
FIG. 4 is a flow chart showing the steps of a method of making the system in accordance with one aspect of the invention.

In another aspect, the present invention includes a method of making a tool set organizer system. The method of making the tool set organizer system can include making or assembling the system to include any number of the specifics set forth above. However, the method of making is not necessarily tied to the specific structure and details of the above described systems. As shown in a flow diagram 115 of FIG. 4A, the method of making the tool set organizer system includes the step of presenting options 120, receiving a request 125, and making or packaging the components 130. By way of example, the method of making can include receiving a request 125 for a base color or texture for a support substrate of the system. A textured support substrate can provide the advantage of frictionally holding a magnet and an attached tool against sliding on the support substrate. The method of making the system can also include a request 125 for a picture to be displayed on the support substrate of the system. Importantly, the method of making the tool organizer system can include a request 125 for a set of position indicators based on a set of tools to be organized. Based on one or more requests 125, the system is then formed to provide an unsupported unenclosed support substrate as a flat sheet for supporting tools in an organized fashion.

Advantageously, the method of making can be facilitated by receiving requests over the Internet. This may be achieved by providing a web site for presenting the features and options that are available for the system. The requestor can then access the web site via a personal computer or the like, and view the features and options that are presented. For example, the web site can have a number of pictures stored on a server, such as can be provided in association with a host computer of the tool organizer system provider. The server can be remote from the computer of the tool organizer system provider, and can be connected via the Internet to the requestor's computer and to the provider's computer. The number of pictures stored on the server provides the same number of pictures that are available for the support substrate from which the requestor can select his or her favorite(s). All the options can thus be selected and ordered over the Internet.

Advantageously, a requestor can indicate a set of tools including a particular brand for any or all of the tools. Based on the requestor's indication of these particular tools, the system can be made to include position indicators that match the particular tools. To this end the position indicators for the tools may include a particular shape, size, and/or color corresponding to the particular tools to be used in the system. In one particular embodiment, the position indicators comprise full sized color pictures of the particular tools with which the system is to be used.

To facilitate receiving the request, the options may include specific predetermined pictures or advertisements that can be included in the system. That is, a requester can browse through a preselected set of pictures to find one or more that appeals to him or her. One option that could be made available is that the entire flat sheet could be covered with one of a plurality of preselected pictures. Alternatively, the requestor could supply the picture that he or she would like displayed on the flat sheet of his system. This aspect of the invention is particularly well suited for receiving requests over the Internet. For example, the requestor could include an attached digital photo with his or her order.

Figure 5:
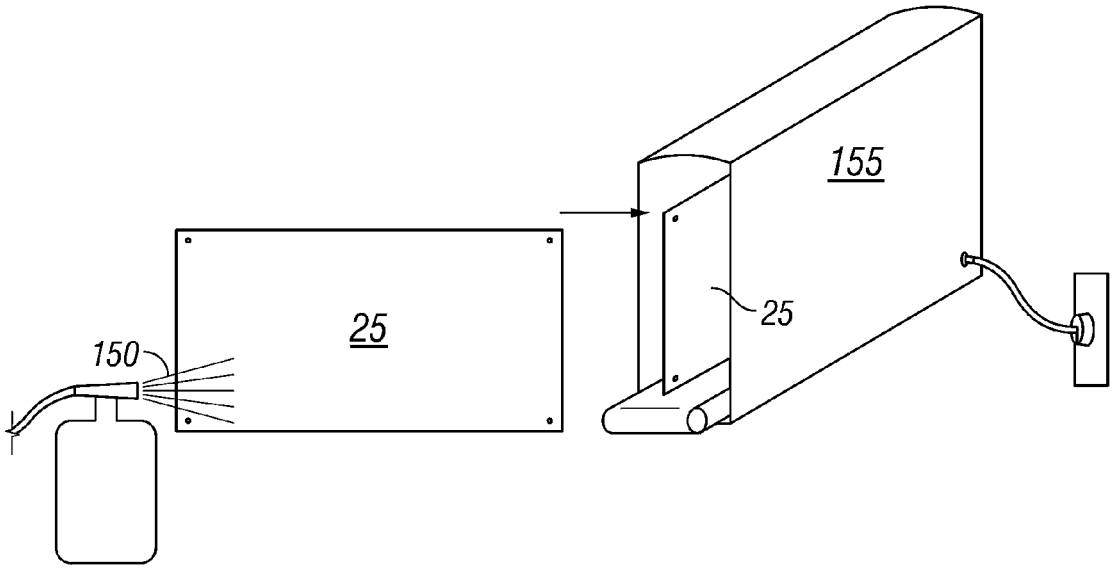
FIG. 5 is a diagrammatic perspective view of another step in the method of making the system of the present invention.

A particular finish can be requested for the front face of the flat sheet. In one form, this finish can be provided by a sprayed powder 150 that is baked at temperatures in a range from 375 degrees F. to 400 degrees F. in an oven 155 as shown in FIG. 5. The oven 155 is exemplary only, and baking the powder coat can be accomplished by open heat lamps or other heating methods and apparatuses as is well known in the art. This method of coating is provided at reduced cost when it is accomplished by an electrostatic process that holds the powder 150 on the flat sheet. The powder 150 consists of finely ground resin and pigment. While a predetermined selection of colors can be provided, it is also to be understood that a virtually unlimited range of colors and textures can be provided. These colors and textures can be provided with high to low gloss finishes with clear or metallic paints. Low gloss finishes and/or rougher textures may be utilized to better hold the magnets connecting the tools to the front face 25. That is, the rougher textures and low gloss finishes can provide a higher coefficient of friction to frictionally engage the magnets and keep the tools and magnets from sliding off the front face. It is to be understood that the finishes are intended to be of high durability so that repeated scraping and contact by tools will not deface the finish of the flat face 25 very easily.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, while the flat sheet of the present invention is typically formed of a sheet of 20 or 22 gage steel material, any sheet including magnetically attracted material is considered within the scope of the invention.

Similarly, while the magnets disclosed herein are typically of a rigid material, magnets of a flexible material could be used instead without departing from the scope of the invention. Likewise, while the position indicators are typically provided as sticky-backed decals, the position indicators could be provided on printable flexible magnetic sheets in the form of printed full size photographs of the tools to be stored. It is to be understood that the present invention can be implemented with the materials and products disclosed herein or with alternatives that function equivalently, including those that have not yet been discovered. Additionally, while the system has been disclosed primarily as having a single flat sheet for the support substrate, support substrates having contours on a front or back face are within the scope of the invention. This is especially so when the contour(s) do not provide a mechanism that, by itself, will hold a tool on the support substrate. The back face of the support substrate can be provided with any contour. In particular, such a contour can be provided to interface with a particular structure on which the support substrate is to be mounted in a more stable manner.

The invention claimed is:

1. A method of storing and organizing tools, comprising the steps of:

mounting on a wall, an unenclosed flat sheet comprising a front face having magnetically attracted material;

selecting a tool mounting position in an area including substantially all of the front face of the flat sheet, the tool mounting position not limited to incremental positions;

placing a position indicator at the tool mounting position; and storing at least one tool on the flat sheet.

2. The method of storing and organizing of claim 1, wherein:

the step of selecting comprises selecting a plurality of tool mounting positions not limited to incremental positions; and the step of placing comprises placing a plurality of position indicating decals at the plurality of tool mounting positions.

3. The method of storing and organizing of claim 1, further comprising:

identifying the at least one tool to be stored on or removed from the flat sheet and;

gripping the at least one tool in overlapping relation to one of the tool mounting positions.

4. The method of storing and organizing of claim 3, wherein the step of storing or removing comprises storing the at least one tool, the method further comprising matching the at least one tool with a position indicator that uniquely corresponds to the at least one tool.

5. The method of storing and organizing of claim 3, wherein the step of storing or removing comprises storing the at least one tool, the method further comprising releasing the at least one tool within a distance from the flat sheet, wherein the distance is in a range from zero to one half inch from the flat sheet.

6. The method of storing and organizing of claim 3, wherein the step of storing or removing comprises storing the at least one tool, the method further comprising magnetically attracting the at least one tool to the flat sheet at any position on the front face not limited to the tool mounting position or the incremental positions.

7. The method of storing and organizing of claim 3, wherein the step of storing or removing comprises storing a plurality of tools comprising the at least one tool, the method further comprising:

magnetically attracting a first subset of the plurality of tools and attaching a second subset of the plurality of the tools by a hook and loop fastener to the flat sheet;

wherein the first and second subsets are equivalent or non-equivalent.

8. The method of storing and organizing of claim 1, wherein the step of selecting a tool mounting position further includes adhering a magnet or one of a hook and loop fastener to the flat sheet.

9. A method of storing and organizing tools, comprising the steps of:

mounting on a wall, an unenclosed flat sheet comprising a front face having magnetically attracted material;

selecting a tool mounting position in an area including substantially all of the front face of the flat sheet, the tool mounting position not limited to incremental positions;

placing a position indicator at the tool mounting position;

identifying at least one tool to be stored on or removed from the flat sheet;

gripping the at least one tool in overlapping relation to one of the tool mounting positions; and storing the at least one tool on or removing the at least one tool from the flat sheet, wherein the step of storing or removing comprises storing the at least one tool, the method further comprising both magnetically attracting the at least one tool and attaching the at least one tool by a hook and loop fastener to the flat sheet.

10. A method of storing and organizing tools, comprising the steps of:

mounting on a wall, an unenclosed flat sheet comprising a front face having magnetically attracted material;

identifying at least one tool to be stored on the flat sheet;

attaching at least one magnet to the at least one tool; and mounting the at least one tool on the flat sheet by magnetic attraction between the at least one magnet and the magnetically attracted material.

11. The method of storing and organizing of claim 10, further comprising:

selecting at least one tool mounting position in an area including substantially all of the front face of the flat sheet, the at least one tool mounting position not limited to incremental positions; and placing at least one position indicator at the at least one tool mounting position.

12. The method of storing and organizing of claim 11, wherein the step of placing the at least one position indicator comprises placing at least one position indicating decal.

13. The method of storing and organizing of claim 11, wherein the step of mounting the at least one tool further comprises matching the at least one tool to the position indicator that uniquely corresponds to the at least one tool.

14. The method of storing and organizing of claim 11, wherein the step of placing the at least one position indicator comprises painting or attaching a silhouette or cutout of a tool shape.

15. The method of storing and organizing of claim 11, wherein the step of placing the at least one position indicator comprises attaching a full sized color picture of the at least one tool.

16. The method of storing and organizing of claim 10, wherein the step of attaching at least one magnet to the at least one tool comprises manufacturing the at least one tool such that the at least one magnet is embedded in the at least one tool.

* * * * *